US009151496B2

(12) United States Patent
Lankinen

(10) Patent No.: US 9,151,496 B2
(45) Date of Patent: Oct. 6, 2015

(54) THERMAL POWER PLANT

(75) Inventor: Pentti Lankinen, Varkaus (FI)

(73) Assignee: AMEC FOSTER WHEELER ENERGIA OY, Espoo (FI)

( * ) Notice: Subject to any disclaimer, the term of this patent is extended or adjusted under 35 U.S.C. 154(b) by 573 days.

(21) Appl. No.: 13/262,970

(22) PCT Filed: Apr. 8, 2010

(86) PCT No.: PCT/FI2010/050282

§ 371 (c)(1),
(2), (4) Date: Dec. 15, 2011

(87) PCT Pub. No.: WO2010/116040

PCT Pub. Date: Oct. 14, 2010

(65) Prior Publication Data

US 2012/0079996 A1 Apr. 5, 2012

(30) Foreign Application Priority Data

Apr. 9, 2009 (FI) ..... 20095401

(51) Int. Cl.
*F22B 37/24* (2006.01)
*F23M 5/00* (2006.01)
(Continued)

(52) U.S. Cl.
CPC ..... *F23M 5/00* (2013.01); *F22B 31/0007* (2013.01); *F22B 37/244* (2013.01); *F23C 10/10* (2013.01); *F23C 10/18* (2013.01)

(58) Field of Classification Search
CPC ..... F22B 37/244; F22B 37/20; F22B 37/24
USPC ..... 122/410, 510, 511, 68.1; 376/462
See application file for complete search history.

(56) References Cited

U.S. PATENT DOCUMENTS 1,527,811 A * 2/1925 Matlock ..... 196/110
1,877,391 A * 9/1932 De Bence ..... 248/58
(Continued)

FOREIGN PATENT DOCUMENTS

CN 1271824 A 11/2000
CN 201028469 Y 2/2008
(Continued)

OTHER PUBLICATIONS

Between—Defintion, Merriam-Webster. www.merriam-websiter.com/dictionary/between.*
(Continued)

*Primary Examiner* — Steven B McCallister
*Assistant Examiner* — Rabeeul Zuberi
(74) *Attorney, Agent, or Firm* — Fitzpatrick, Cella, Harper & Scinto

(57) ABSTRACT

A thermal power boiler includes a furnace enclosed by two short side walls and two long side walls, flue gas channels arranged above the furnace, a back pass and a supporting structure. The supporting structure includes a stationary bearing structure supported from below. The bearing structure includes multiple vertical pillars and a parallel main supporting beams supported by the vertical pillars, and a suspension structure, so that the furnace hangs from the bearing structure. The main supporting beams and the flue gas channels arranged above the furnace are parallel with each other and parallel with the short side walls. The main supporting beams are preferably arranged at least partially between the flue gas channels extending over the roof of the furnace.

12 Claims, 2 Drawing Sheets

(51) Int. Cl.

| | |
|---|---|
| ***F22B 31/00*** | (2006.01) |
| ***F23C 10/10*** | (2006.01) |
| ***F23C 10/18*** | (2006.01) |

(56) References Cited

U.S. PATENT DOCUMENTS

| | | | | | |
|---|---|---|---|---|---|
| 3,368,535 | A | * | 2/1968 | Svendsen et al. | 122/510 |
| 3,379,177 | A | * | 4/1968 | Stalph | 122/6 A |
| 3,608,525 | A | * | 9/1971 | Sharan | 122/6 A |
| 3,927,646 | A | | 12/1975 | Dungey et al. | |
| 3,982,902 | A | * | 9/1976 | Lortz | 422/147 |
| 4,063,534 | A | * | 12/1977 | Kral | 122/510 |
| 4,286,549 | A | * | 9/1981 | Eisinger | 122/510 |
| 4,761,131 | A | * | 8/1988 | Abdulally | 431/7 |
| 5,339,891 | A | * | 8/1994 | Kidaloski et al. | 165/67 |
| 5,722,354 | A | * | 3/1998 | Sansoucy | 122/510 |
| 6,039,008 | A | * | 3/2000 | Anderson et al. | 122/510 |
| 6,305,330 | B1 | * | 10/2001 | Darling | 122/4 D |
| 7,240,640 | B2 | * | 7/2007 | Kinnunen | 122/450 |
| 7,275,503 | B2 | | 10/2007 | Waseda et al. | |
| 2006/0175040 | A1 | | 8/2006 | Waseda et al. | |
| 2007/0272172 | A1 | * | 11/2007 | Kawaguchi et al. | 122/510 |

FOREIGN PATENT DOCUMENTS

| | | | |
|---|---|---|---|
| CN | 201100628 | Y | 8/2008 |
| DE | 3441972 | A1 | 5/1986 |
| FI | 100206 | B | 10/1997 |
| JP | 5-240405 | A | 9/1993 |
| JP | 11-159155 | A | 6/1999 |
| JP | 2002-130608 | A | 5/2002 |
| RU | 2129234 | C1 | 4/1999 |
| RU | 12456 | U1 | 1/2000 |
| WO | 98/51964 | A1 | 11/1998 |
| WO | 01/65175 | A1 | 9/2001 |
| WO | 2004/048849 | A1 | 6/2004 |
| WO | 2007/135238 | A2 | 11/2007 |

OTHER PUBLICATIONS

Chinese Official Action dated Sep. 29, 2013, issued in corresponding Chinese Patent Application No. 201080016036.9, with an English translation.

Russian Decision on Grant dated Apr. 26, 2013, mailed in corresponding Russian Patent Application No. 2011145271/06(067817), with an English translation.

Abroll, Von G., et al., "Groesster Wirbelschicht-Kraftwerksblock Zur Strom-und Fermwaermeversorgung Fuer Berlin," VGB Kraftwerkstechnik, VGB Kraftwerkstechnik, GMBH, Essen, DE, vol. 71, No. 11, Nov. 1, 1991. pp. 102-0130.

Notification of and International Search Report completed Jan. 19, 2012, and mailed Jan. 31, 2012, in counterpart International Application No. PCT/FI2010/050282.

Written Opinion mailed Jan. 31, 2012, in counterpart International Application No. PCT/FI2010/050282.

Finnish Office Action dated Nov. 24, 2009, issued in counterpart Finnish patent application No. 20095401.

* cited by examiner

THERMAL POWER PLANT

This application is a U.S. national stage application of PCT International Application No. PCT/FI2010/050282, filed Apr. 8, 2010, published as PCT Publication No. WO 2010/116040 A2, and which claims priority from Finnish patent application number 20095401, filed Apr. 9, 2009.

FIELD OF THE INVENTION

The present invention relates to a thermal power boiler plant. The invention more particularly relates to a thermal power boiler plant comprising a furnace enclosed by two short side walls and two long side walls, a flue gas channel arranged above the furnace, a back pass and a supporting structure, which supporting structure comprises a stationary bearing structure supported from below, the bearing structure comprising multiple vertical pillars and main supporting beams supported by the vertical pillars, and a suspension structure, by means of which the furnace hangs from the bearing structure.

There is a tendency to increase the capacity of thermal power boilers, such as circulating fluidized bed boilers by changing to larger and larger units. The capacity of the largest manufactured circulating fluidized bed boiler nowadays is 430 MWe, but there are already plans for constructing 600 MWe and even 800 MWe plants. As the equipment of the boiler structure, such as the furnace, the flue gas channels and the back pass increase, the lengths and cross-sectional areas of the pillars and beams of the supporting structure must also increase.

When increasing the outer dimensions of the supporting structure, the wind load of the boiler building and the load weight of the supporting structure also increases. This results in that the strength of the supporting structure must be further increased, which again results in a further increase in the weight of the supporting structure. The increase of the size and weight of the supporting structure increases material costs and complicates the assembly of the plant. Therefore, it is important to find solutions to restrain the increase of the supporting structure due to the increase in the size of the thermal power boiler plant.

BACKGROUND OF THE INVENTION

The furnace walls in the modern thermal power boilers are usually relatively light water tube walls, which have a high tensile strength, but they do not endure much compression or bending. Thus, large thermal power boilers are usually supported from above, which means that the furnace of the boiler has been suspended to hang from a stationary bearing structure surrounding the furnace by means of hanger rods attached to the upper portions of the side walls of the furnace.

The main elements of the bearing structure usually consist of vertical pillars and horizontal main supporting beams supported on the top of the pillars or to the upper portion thereof, to which outer supporting beams of the bearing structure and the suspending structure of the furnace are supported. In some thermal power boiler plants, the main supporting beams form a grid above the boiler structure, which comprises main supporting beams, longitudinal and traverse relative to the furnace. The present invention, however, relates to a thermal power plant, having parallel main supporting beams supporting the boiler structures. The main supporting beams are usually 2-6 m high steel beams, for example, I beams, the length of which may be even more than 30 m, and which often weigh more than 100 tons. The main supporting beams are usually connected to other horizontal beams that are, however, smaller than the main supporting beams of that size.

There are other boiler structures that are integrated to the furnace of the boiler, especially, a back pass comprising heat exchange surfaces and channels for leading flue gas from the furnace to the back pass. The back pass and the flue gas channels leading thereto can be suspended to hang, according to the prior art, with the furnace from a shared supporting structure. The supporting structure of a thermal power boiler is generally a mainly right rectangular prism, and dimensioned in such a way that at least the furnace, flue gas channels, and back pass can be placed therein. Thus, the size of the supporting structure depends on the size of the holler structure and the mutual positioning of the parts thereof.

The height of a modern large thermal power plant is several tens of meters, typically, at least about 50 m. One factor adding to the height of the thermal power plant in accordance with the prior art is that a sufficient length is required for the hanger rods of the furnace due to the horizontal thermal expansion of the furnace.

The present invention especially relates to a thermal power boiler plant having flue gas channels arranged above the furnace. According to the prior art, the flue gas channels arranged above the furnace are suspended to hang from the main supporting beams, and, therefore, the height of such a thermal power boiler plant is especially high. One result of the flue gas channels being arranged above the furnace is that they also cause the hanger rods of the suspension structure of the furnace in accordance with the prior art to become long.

Long hanger rods are problematic, especially because the temperature of the hanger rods mounted to the upper portion of the furnace follows, to a certain extent, the temperature of the furnace walls, which causes relatively high thermal expansion of the hanger rods. Thus, the design of the supporting structure has to be such that the thermal expansion of the supporting beams does not cause any breaking of the boiler structures.

As the furnace walls do not endure heavy local forces, the distances between the hanger rods supporting the furnace from the supporting structure have to be small enough. Densely positioned hanger rods, however, make the use of the space above the furnace more difficult, for example, when arranging the flue gas channels above the furnace. Alternatively, it can be said that the flue gas channels above the furnace hinder the arrangement of hanger rods close enough to each other.

SUMMARY OF THE INVENTION

An object of the present invention is to provide a thermal power boiler plant, in which the problems of the prior art described above are diminished. It is especially an object to provide a large thermal power boiler plant, the supporting structure of which is lighter and smaller in size than that of the supporting structure of the thermal power boiler plant of the prior art.

In order to solve the problems of the prior art mentioned above, a thermal power boiler plant is provided, the characterizing features of which have been disclosed in the characterizing part of the independent claim. Thus, it is typical of the present thermal power boiler plant that the main supporting beams and the flue gas channel arranged above the furnace are parallel with each other and aligned with the short side walls.

When the flue gas channels arranged above the furnace and the main supporting beams are parallel, it is possible to arrange them in the vertical direction close to each other, whereby the height of the thermal power boiler plant remains smaller than that in a plant, in which the flue gas channels are clearly at a different height than that of the main supporting beams. If the flue gas channels and the main supporting beams are not parallel, the flue gas channels have to be either above or below the main supporting beams. Arranging the main supporting beams and the flue gas channels arranged above the furnace to align with the short side walls results in a compact structure of the plant, in which the back pass is preferably arranged on the side of a long side wall of the furnace.

According to an especially advantageous embodiment of the invention, the main supporting beams are arranged in such a way that, as seen from the side, they are at least partially between the flue gas channels arranged above the furnace. This means that the upper surface of the flue gas channels is higher than that of the lower surface of the main supporting beams. As the height of both the main supporting beams and the flue gas channels can be several meters, their arrangement to be at least partially interposed may diminish the height of the plant by several meters.

At least a portion of the flue gas channels arranged above the furnace is preferably supported on top of secondary supporting beams hanging from the main supporting beams. The secondary supporting beams also act as an assembly and lift beams during the assembly. The secondary supporting beams may directly hang from the main supporting beams, but according to an especially advantageous embodiment, the secondary supporting beams hang from upper supporting beams supported on top of the main supporting beams.

In the circulating fluidized bed boilers, the roof of the vortex chambers of the particle separators is usually at approximately the same height as that of the roof of the furnace. According to a conventional technique, the flue gas cleaned in the particle separator is removed from the particle separator upwards through an outlet channel, which causes the flue gas channels to be usually at a higher level than that of the furnace. As the flue gas channels leading to the back pass are usually at least mainly horizontal, the roof of the back pass is usually at a higher level than the roof of the furnace.

The main supporting beams supporting the furnace can preferably be arranged at least partially interposed with the flue gas channels, whereby the main supporting beams can preferably be approximately at the same height as the roof of the back pass. Therefore, according to an especially advantageous embodiment, the bearing structure of the thermal power boiler plant comprises main supporting beams arranged above the back pass, the main supporting beams being arranged higher than the main supporting beams arranged on top of the furnace. Thus, free space is formed above the furnace, which can preferably be used, for example, to locate the safety valves for superheated steam.

The flue gas channels leading over the roof are preferably identical with each other up until the side wall of the back pass arranged on the side of a long side wall of the furnace. When the main supporting beams are arranged according to the present invention, parallel with the flue gas channels leading over the roof, it is possible to preferably arrange at least a portion of the pillars supporting the main supporting beams to the foundation of the thermal power boiler plant between the flue gas channels or the extensions thereof.

According to a preferred embodiment of the present invention, the suspension structure comprises upper hanger rods hanging from the main supporting beams, intermediary supporting beams hanging from the upper hanger rods and lower hanger rods attached to the upper portion of the furnace and hanging from the intermediary supporting beams. A portion of the upper hanger rods may hang directly from the main supporting beams, but preferably, the bearing structure comprises upper supporting beams supported on top of the main supporting beams, and at least a portion of the upper hanger rods is suspended to hang from the upper supporting beams, whereby at least a portion of the intermediary supporting beams hangs from the upper supporting beams by means of upper hanger rods.

As the main supporting beams are mounted directly to the upper portion of the pillars, the location thereof naturally depends on the location of the pillars. Upper supporting beams instead may be arranged rather freely on top of the main supporting beams, and, therefore, the lengths and locations of the intermediary supporting beams hanging from the upper supporting beams can be selected according to the needs. When the upper supporting beams are located reasonably, it is possible to optimize the lengths and thicknesses of the intermediary hanger rods according to the pieces to be suspended.

As the side walls of the furnace do not endure great local, vertical loads, there must be hanger rods connected to the furnace densely enough, typically, at least about two hanger rods per one meter. When the intermediary supporting beams arranged between the main supporting beams and the furnace are strong enough, the number of the upper hanger rods can be significantly less than the number of the lower hanger rods attached to the furnace. Typically, there is less than one upper hanger rod per meter. Thus, the number N of the upper hanger rods is preferably less than the number M of the lower hanger rods, most preferably, N is less than M/2.

The intermediary supporting beams are preferably arranged relatively close to the furnace, but generally, however, above the heat insulation of the furnace. When the lower hanger rods are relatively short, the thermal expansion thereof remains minor. Preferably, at least the majority of the intermediary supporting beams has been arranged such that the vertical distance between the supporting beams and the intermediary supporting beams is greater, most preferably, at least two times greater, than the distance between the intermediary supporting beams and the furnace. Thereby, a relatively large amount of space remains above the intermediary supporting beams, in which space, different equipment and parts can be arranged above the furnace. According to a preferred embodiment of the invention, the flue gas channels arranged above the furnace are preferably arranged above the intermediary supporting beams.

Since intermediary supporting beams are used for supporting the side walls of the furnace, at least a portion of the intermediary supporting beams is advantageously arranged directly above the side walls of the furnace and connected by lower hanger rods to the upper parts of the side walls of the furnace. According to a preferred embodiment, all intermediary supporting beams are, however, not arranged above the side walls of the furnace, but at least a portion of the intermediary supporting beams can be arranged as central supporting beams arranged above the center part of the furnace roof. Such central supporting beams are preferably arranged to support the equipment and parts provided in the furnace. According to a preferred embodiment, heat exchange surfaces arranged in the furnace are suspended to hang from the central supporting beams.

Since the width of the side walls of the furnace in a large thermal power boiler can be tens of meters, for example, about forty meters, the thermal expansion of the furnace walls downwards and sideways during the start-up of a boiler is significant. As the changes in the temperature of the intermediary supporting beams are significantly less than the changes in the temperature of the furnace, the thermal expansion causes considerable stress in the lower hanger rods attached with a central supporting beam having the length of the side-wall and in the attachment points of the hanger rods. Therefore, at least a portion of the intermediary supporting beams is preferably formed of separate, parallel portions arranged one after another. Thereby, the length of each continuous portion of the intermediary supporting beams can be maintained small enough, and the stresses caused by the thermal expansion can be minimized.

BRIEF DESCRIPTION OF THE DRAWINGS

The invention is described below with reference to the accompanying drawings, in which.

DETAILED DESCRIPTION OF THE PREFERRED EMBODIMENTS

Figure 1:
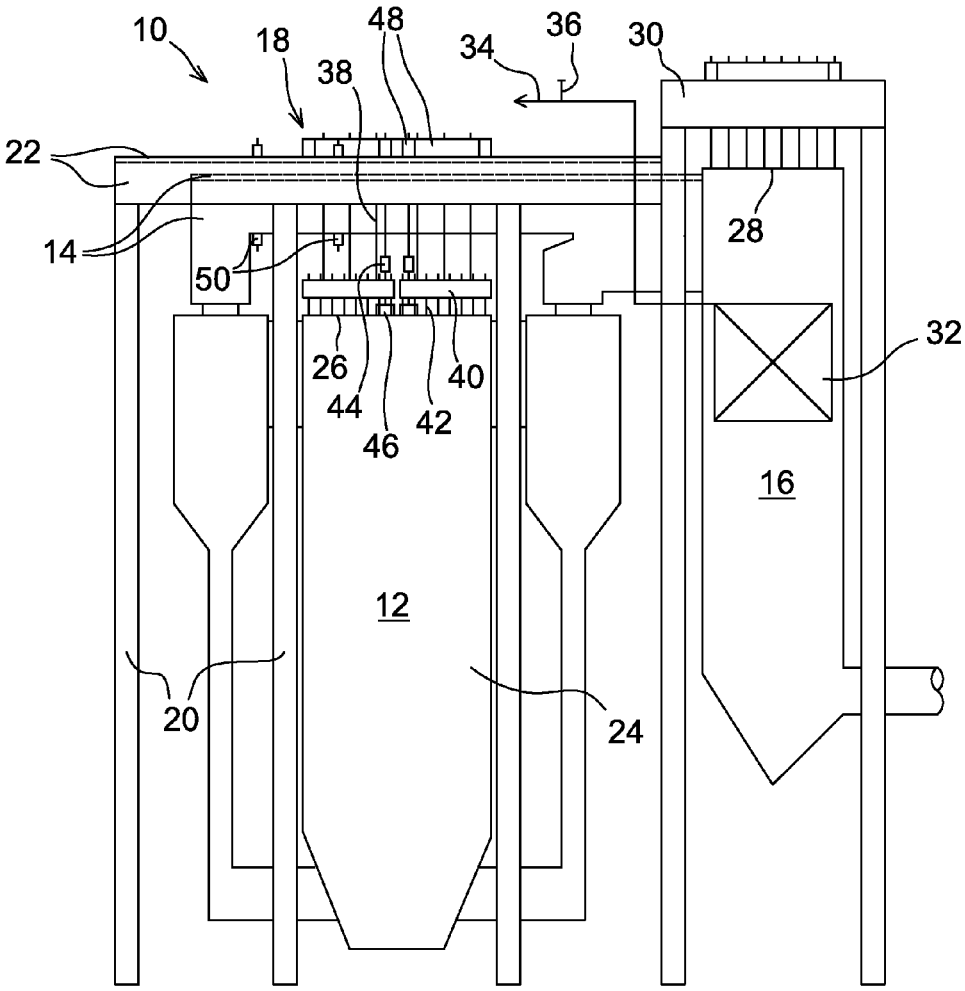
FIG. 1 is a schematic side view of a circulating fluidized bed boiler plant in accordance with a preferred embodiment of the invention.

A circulating fluidized bed boiler plant 10 shown in FIG. 1 is an example of a thermal power boiler plant in accordance with the present invention. The circulating fluidized bed boiler plant 10 comprises a boiler structure having a furnace, flue gas channels 14 arranged above the furnace, a back pass 16, as well as a supporting structure having, as main parts, a suspension structure 18 and a bearing structure, the bearing structure comprising pillars 20 and main supporting beams 22 of the furnace parallel with the flue gas channels and supported by the vertical pillars.

Figure 2:
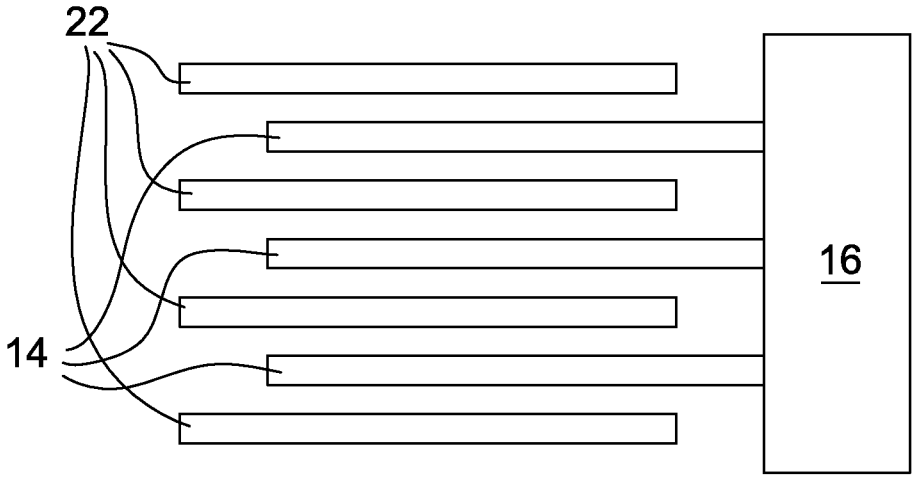
FIG. 2 is a schematic plan view of a circulating fluidized bed boiler plant in accordance with a preferred embodiment of the invention.

The furnace is enclosed by two short side walls and two long side walls of which only one side wall 24 is shown in FIG. 1. As can be seen in FIG. 1, both the flue gas channels 14 and the main supporting beams 22 are traverse relative to the furnace, in other words, parallel to the short side walls 24 of the furnace. FIG. 1 only shows one main supporting beam 22 of the furnace and one flue gas channel 14 partially behind the beam 22, the part of the flue gas channel remaining behind the main supporting beam being indicated by a broken line. In reality, as is schematically shown in FIG. 2, there are numerous, preferably, four or five of the main supporting beams 22 of the furnace 12, and between each two main supporting beams 22 there is a flue gas channel 14.

Arranging main supporting beams 22 partially between the flue gas channels 14 in accordance with a preferred embodiment, of the invention results in that the supporting structure at the furnace is relatively lower than it would be when using a prior art solution, in which the main supporting beams are, as a whole, above the flue gas channels. The supporting structure becoming lower means, in practice, that the pillars are clearly lower and thus less expensive than when using the conventional solution.

As is generally the case in circulating fluidized bed boilers, in the embodiment of FIG. 1, the roof 26 of the furnace is significantly lower than the roof 28 of the back pass 16. As the main supporting beams 22 above the furnace are partially between the flue gas channels 14, they are located at a lower height than the main supporting beams 30 of the back pass. As a result of this solution, in accordance with a preferred embodiment of the invention, is that there is a lot of space remaining above the furnace, rendering it possible to place there different equipment and parts, such as steam pipes 34, as well as safety valves 36 for steam pipes transferring superheated steam from the super heaters 32 of the back pass to the steam turbine (which is not shown in FIG. 1).

The furnace 12 is hanging from the bearing structure by means of a suspension structure 18, comprising higher hanger rods 38, intermediary supporting beams 40 and lower hanger rods 42. As the wall structure of the furnace does not endure heavy local stresses, the lower hanger rods 42 attached to the upper portion of the furnace must be set densely enough, typically, about two beams per meter. The lower hanger rods 42 are attached to the intermediary supporting beams 40, which again hang by means of the upper hanger rods 38 from the bearing structure, which is why the upper hanger rods can be less densely placed than the lower hanging rods. Preferably, there is less than one rod per meter of them.

The use of intermediary supporting beams 40 and the sparsely set upper hanger rods decreases the tightness in the space above the furnace 12 above the intermediary supporting beams. Thus, it is possible to advantageously arrange different equipment and parts above the intermediary supporting beams 40. Especially, in the arrangement disclosed in FIG. 1, the use of intermediary supporting beams 40 considerably facilitates the location of the flue gas channels 14 above the furnace 12.

In order to be able to advantageously suspend the side walls 24 of the furnace to hang from the intermediary supporting beams, a portion of the intermediary supporting beams 40 is arranged directly above the side walls of the furnace 12. As the thermal expansion of the furnace 12 is clearly greater than the thermal expansion of the intermediary supporting beams, the intermediary supporting beams 40 preferably comprise separate, parallel portions arranged one after another. A portion of the intermediary supporting beams may also preferably be arranged in other positions than above the side walls of the furnace. Especially, FIG. 1 shows intermediary supporting beams 44 arranged above the center portion of the furnace, of which intermediary supporting beams heat exchange surfaces 46 inside the furnace are suspended to hang.

As the main supporting beams 22 are parallel and they are relatively sparse, at least not all upper hanger rods 38 are attached to the main supporting beams, but they are suspended to hang from the main supporting beams by means of longitudinal and traverse upper supporting beams 48 arranged above the main supporting beams. Preferably, at least a portion of the flue gas channels 14 arranged above the furnace is supported on top of secondary supporting beams 50 hanging from the main supporting beams 22.

The invention has been described above with reference to some exemplary embodiments. However, the invention also covers various combinations or modifications of the disclosed embodiments. Especially, the thermal power boiler does not have to be a circulating fluidized bed boiler, but it can be of another boiler type having transverse flue gas channels arranged on top of the furnace. Thus, it is obvious that the invention is not intended to be limited only to the embodiments disclosed above, but it is limited merely by the appended claims and their definitions.

The invention claimed is:

1. A thermal power boiler comprising:

a furnace for combusting fuel and generating flue gas, the furnace having a roof, and being enclosed by two short side walls and two long side walls;

a plurality of flue gas channels, arranged above the furnace and extending over the roof of the furnace, for receiving the flue gas from the furnace;

a back pass comprising heat exchange surfaces and for receiving the flue gas from the flue gas channels; and a supporting structure, which supporting structure comprises a stationary bearing structure supported from below, said stationary bearing structure comprising (i) multiple vertical pillars, (ii) a plurality of parallel main supporting beams supported by the multiple vertical pillars, and (iii) a suspension structure, by means of which suspension structure, the furnace hangs from the stationary bearing structure, wherein the plurality of main supporting beams are parallel with the plurality flue gas channels arranged above the furnace and are parallel with the two short side walls of the furnace, and wherein corresponding ones of the plurality of the main supporting beams, which are parallel with the plurality of flue gas channels arranged above the furnace, are arranged at least partially interposed between corresponding ones of the plurality of the flue gas channels;

wherein secondary supporting beams are hanging from the main supporting beams, wherein at least a portion of the flue gas channels arranged above the furnace is supported on the secondary supporting beams hanging from the main supporting beams.

2. A thermal power boiler in accordance with claim 1, wherein the bearing structure further comprises main supporting beams arranged over the back pass, which main supporting beams are arranged higher than the main supporting beams arranged above the furnace.

3. A thermal power boiler in accordance with claim 1, wherein at least a portion of the pillars is arranged between the flue gas channels extending over the roof.

4. A thermal power boiler in accordance with claim 1, wherein the suspension structure comprises upper hanger rods hanging from the main supporting beams, intermediary supporting beams hanging from the upper hanger rods, and lower hanger rods connected to the top portion of the furnace and hanging from the intermediary supporting beams.

5. A thermal power boiler in accordance with claim 4, wherein the bearing structure further comprises upper supporting beams supported on top of the main supporting beams, and at least a portion of the intermediary supporting beams is suspended to hang from the upper supporting beams by upper hanger rods.

6. A thermal power boiler in accordance with claim 4, wherein at least a portion of the intermediary supporting beams is formed of separate parallel portions.

7. A thermal power boiler in accordance with claim 4, wherein at least a portion of the intermediary beams is arranged above the side walls of the furnace and connected to the upper portions of the side walls of the furnace by lower hanger rods.

8. A thermal power boiler in accordance with claim 4, wherein the flue gas channels arranged above the furnace are arranged above the intermediary beams.

9. A thermal power boiler in accordance with claim 4, wherein at least a portion of the intermediary beams is arranged as central supporting beams positioned above the central portion of the roof, said central supporting beams being connected by lower hanger rods to heat exchange surfaces arranged inside of the furnace.

10. A thermal boiler in accordance with claim 1, wherein the plurality of main supporting beams is arranged such that, as seen from the side, the plurality of main supporting beams is at least partially between the plurality of flue gas channels extending over the roof of the furnace.

11. A thermal boiler in accordance with claim 1, wherein an upper surface of a respective one of the plurality of gas channels is higher in elevation than a lower surface of a corresponding one of the plurality of main supporting beams.

12. A thermal boiler in accordance with claim 1, wherein corresponding ones of the plurality of main supporting beams alternate with corresponding ones of the plurality of flue gas channels.

* * * * *